US005330050A

United States Patent [19]

Stansbury, Jr. et al.

[11] Patent Number: 5,330,050

[45] Date of Patent: Jul. 19, 1994

[54] PALLET MERCHANDISING SYSTEM FOR CONTAINERS

[75] Inventors: Benjamin H. Stansbury, Jr., Los Angeles, Calif.; Robert G. Dickie, Newmarket, Canada

[73] Assignee: Cornos Corporation, Scarborough, Canada

[21] Appl. No.: 150,902

[22] Filed: Nov. 12, 1993

[51] Int. Cl.[5] ..... B65D 19/00

[52] U.S. Cl. ..... 206/386; 206/430; 206/579; 206/821

[58] Field of Search ..... 206/196, 386, 430, 520, 206/593, 597, 595, 821, 592; 220/23.6

[56] References Cited

U.S. PATENT DOCUMENTS

| | | | |
|---|---|---|---|
| 3,351,264 | 11/1967 | Bostrom | 206/593 |
| 3,385,429 | 5/1968 | Becker et al. | 206/821 |
| 4,567,981 | 2/1986 | Headon | 206/821 |
| 4,667,823 | 5/1987 | Wolfe, Jr. et al. | 206/597 |
| 4,735,321 | 4/1988 | Day | 206/597 |
| 4,739,884 | 4/1988 | Duplessy | 206/430 |
| 4,838,419 | 6/1989 | Weits et al. | 206/386 |
| 4,848,573 | 7/1989 | Salacuse | 206/821 |
| 4,865,202 | 9/1989 | Day | 206/597 |
| 4,877,142 | 10/1989 | Doering | 206/386 |
| 4,998,619 | 3/1991 | Sowa et al. | 206/386 |
| 5,016,761 | 5/1991 | Stoddard et al. | 206/597 |
| 5,038,961 | 8/1991 | Watanabe et al. | 206/821 |

FOREIGN PATENT DOCUMENTS

| | | | |
|---|---|---|---|
| 99827 | 2/1984 | European Pat. Off. | 206/821 |
| 2240326 | 7/1991 | United Kingdom | 206/821 |

*Primary Examiner*—David T. Fidei

*Attorney, Agent, or Firm*—Jeffrey T. Imai; Arne I. Fors; D. Doak Horne

[57] ABSTRACT

A palletized merchandising system comprises a pallet, a plurality of like containers stacked in layers on the pallet and a divider sheet interposed between the layers of like containers. The like containers comprise a unitary blow molded body of a generally parallelepiped shape. The like containers have a top face, bottom face, a front face and side walls and a diagonally extending parting line. A pour spout in the top face is spaced along the parting line towards one corner of the top face. A handle on the top face extends upwardly from the top face and is spaced along the parting line. A recess in the bottom face extends upwardly therefrom and is spaced along the parting line. The recess is sized to receive a handle of a like container in a stacking relation. The divider sheets have a plurality of apertures adapted to receive the handles of the like containers and to orient the front face of the like containers when an upper layer of like containers is stacked over a lower layer of like containers.

1 Claim, 7 Drawing Sheets

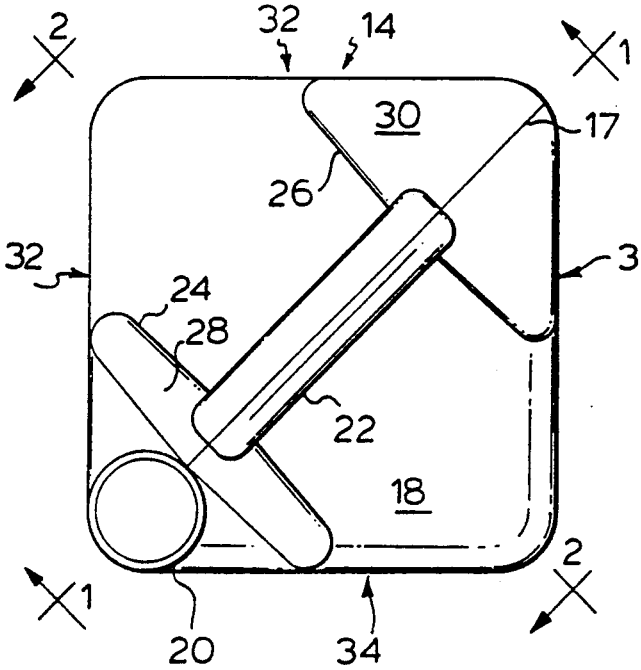
FIG. 2.
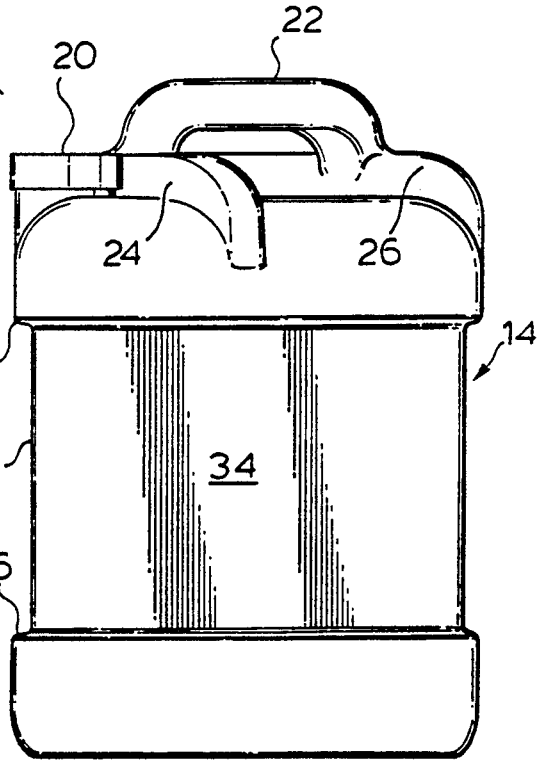
FIG. 3.
FIG. 4.
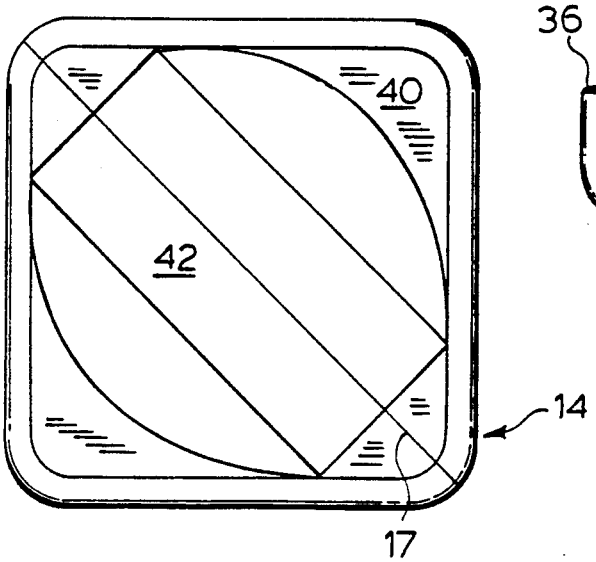

PALLET MERCHANDISING SYSTEM FOR CONTAINERS

FIELD OF INVENTION

This invention relates to a system for palletizing containers for storage, shipment, which system ultimately acts as a retail display merchandiser at the point of sale.

BACKGROUND OF INVENTION

Warehouse or mass merchandising has become a popular form of retail selling. The manufacturer packages the merchandise, loads it onto pallets and ships in bulk to a retailer. The retailer places the pallets of the merchandise in a storage area, aisle or in a strategic high traffic area of a large warehouse. The consumer is permitted to wander through the warehouse collecting the desired merchandise. The retailer is able to reduce costs for stocking shelves, tagging, unpacking and displaying the merchandise. These costs savings are passed onto the consumer.

The merchandise is normally left in the cartons and on pallets presenting an unattractive display. In the case of bottled product, such as windshield washer fluid, driveway sealer, varsol, deck sealer, asphalt patching compound, fertilizer and other liquids which are normally sold in large containers, the containers are stacked in layers. When a consumer removes a container, it may not be the uppermost container which may cause the stack of containers to collapse. Since the retailer has a reduced staff, the disarray of containers may persist for an extended period of time. On seeing a disarray of containers, subsequent consumers may be influenced negatively and ultimately select a product from a different display, often a competitive product.

There are numerous container designs which are stackable and suitable present unique problems. First, these bottle containers are designed to interlock vertically making it difficult for a consumer to remove an upper bottle from the immediately lower bottle. Second, the upper bottle container must be alternated or rotated relative to the immediately lower bottle container presenting an alternating pattern to the front label of the product.

SUMMARY OF THE INVENTION

The disadvantages of the prior art may be overcome by providing a palletized merchandising system in which a product may be contained, stored, shipped and merchandised without requiring the product from being unpackaged and shelved.

It is desirable to provide a palletized merchandising system comprising a bottle container which is stackable and is efficiently and stably loadable onto the pallet.

It is further desirable to provide a palletized merchandising system having a plurality of dividers for stabilizing the stack of bottle containers and for orienting the bottle containers for presenting a uniform frontal appearance of the merchandising system.

According to one aspect of the invention, there is provided a palletized merchandising system comprising a pallet, a plurality of like containers stacked in layers on the pallet and a divider sheet interposed between the layers of like containers. The like containers comprise a unitary blow molded body of a generally parallelepiped shape. The like containers have a top face, bottom face, a front face and side walls and a diagonally extending parting line. A pour spout in the top face is spaced along the parting line towards one corner of the top face. A handle on the parting line. The recess is sized to receive a handle of a like container in a stacking relation. The divider sheets have a plurality of apertures adapted to receive the handles of the like containers and to orient the front face of the like containers when an upper layer of like containers is stacked over a lower layer of like containers.

DESCRIPTION OF THE DRAWINGS

In figures which illustrate embodiments of the invention,

FIG. 2 is a top plan view of the bottle according to the invention of FIG. 1;

FIG. 3 is a front elevational view of the bottle according to the invention of FIG. 1;

FIG. 4 is a bottom view of the bottle according to the invention of FIG. 1;

DESCRIPTION OF THE INVENTION

Figure 1:
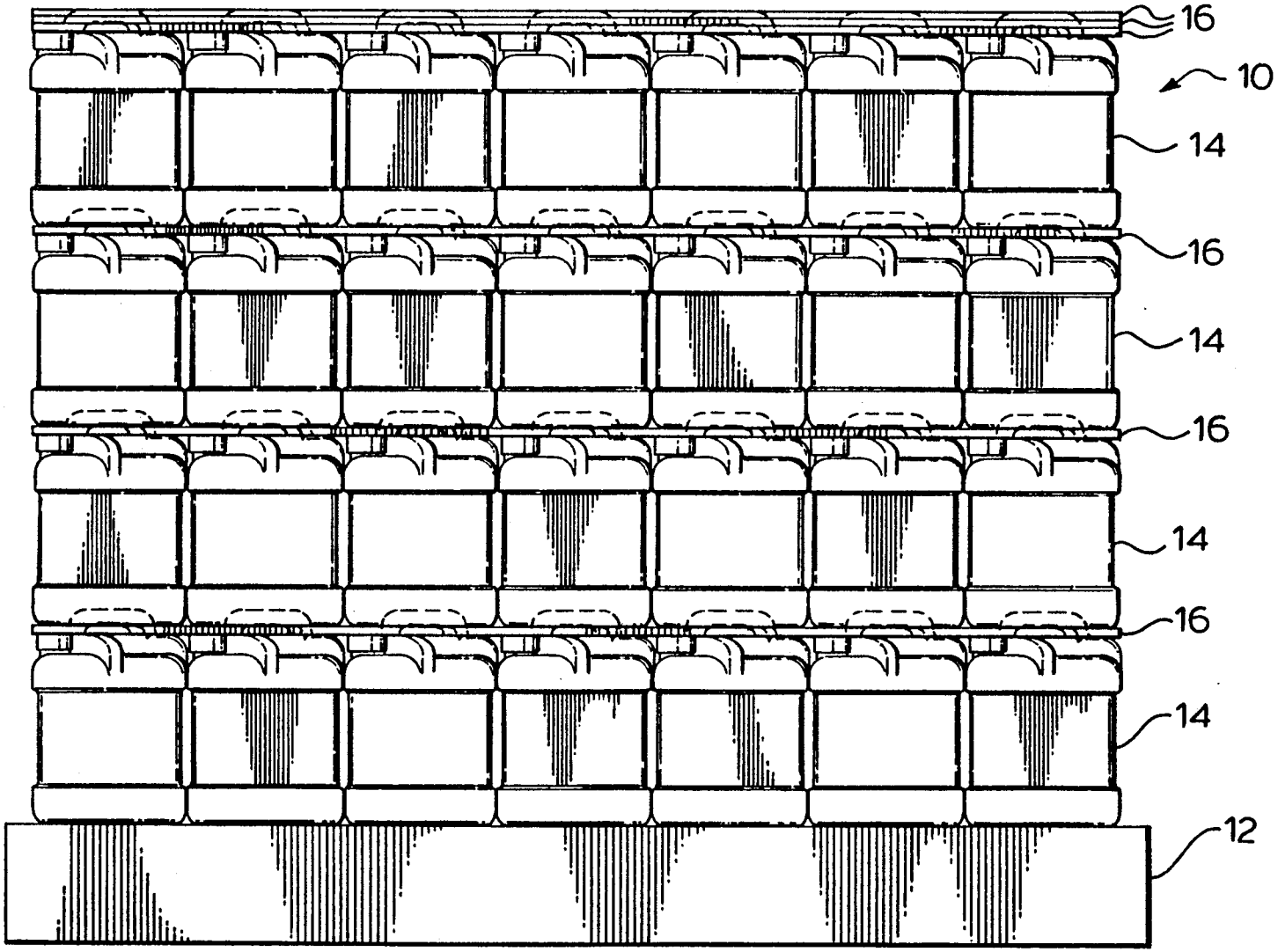
FIG. 1 is a front elevational view of a pallet merchandising system according to the present invention.

Referring to FIG. 1, the pallet merchandising system of the present invention is generally illustrated as 10. The system comprises a pallet 12, a plurality of rows of bottle containers 14 and dividers 16.

Referring to FIGS. 2, 3 and 4, bottle container 14 has a hollow body having a generally parallelepiped shape. In the preferred embodiment, the bottle container 14 is generally cubic as a cubic design is the most efficient use of space for a given volume. However, other sizes are contemplated by elongating the height of the bottle yet maintaining the generally square shape in plan view.

Bottle container 14 is blow molded using standard blow molding equipment and procedures which are well known in the art. The bottle container 14 has a diagonally extending parting line which is the line on the bottle container which is produced along the line where each half of the molds meet. On the top face 18 of the bottle container 14 is spout 20 and handle 22. Both spout 20 and handle 22 are spaced along the parting line 17. Spout 20 is positioned in one corner of top face 18. Extending upwardly from the top face 18 is supports 24 and 26 presenting support surfaces 28 and 30. Support surfaces 28 and 30 are substantially coplanar with the upper level of spout 20. Handle 22 extends upwardly from support surfaces 28 and 30. Supports 24 and 26 can be of any shape provided the blow molded bottle container 14 is removable from the mold halves. In the preferred embodiment, supports 24 and 26 together with handle 22 are generally hollow and integrally blow molded.

Bottle container 14 had three side walls 32 and one front wall 34. Side walls 32 and front wall 34 have two corners 36 presenting a substantially planar front wall 34. Various types of labels may be used, including self-adhesive and wrap-around labels.

Figure 5:
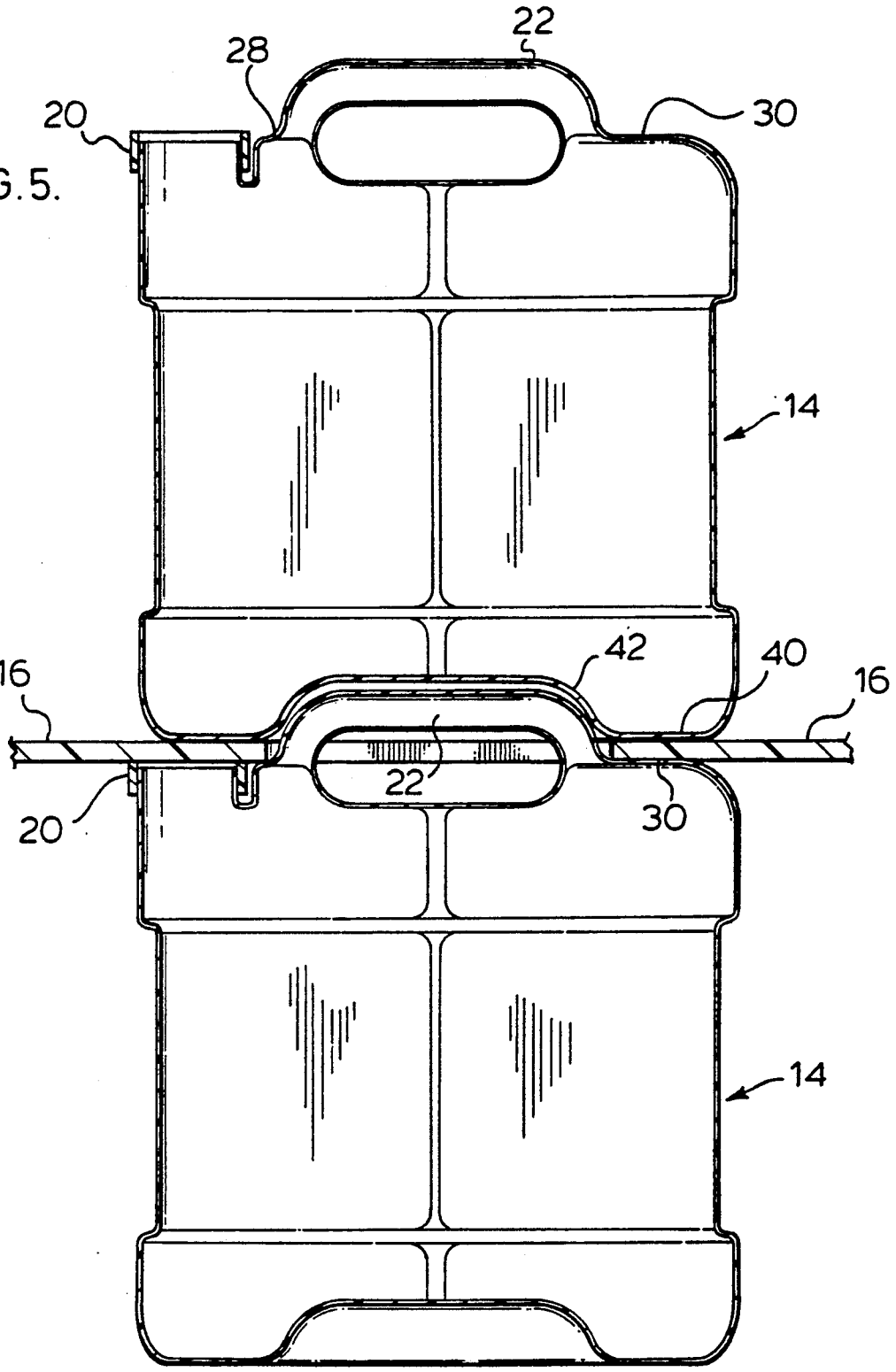
FIG. 5 is a sectional view of two stacked bottles along the lines 1—1 of FIG. 2.
Figure 6:
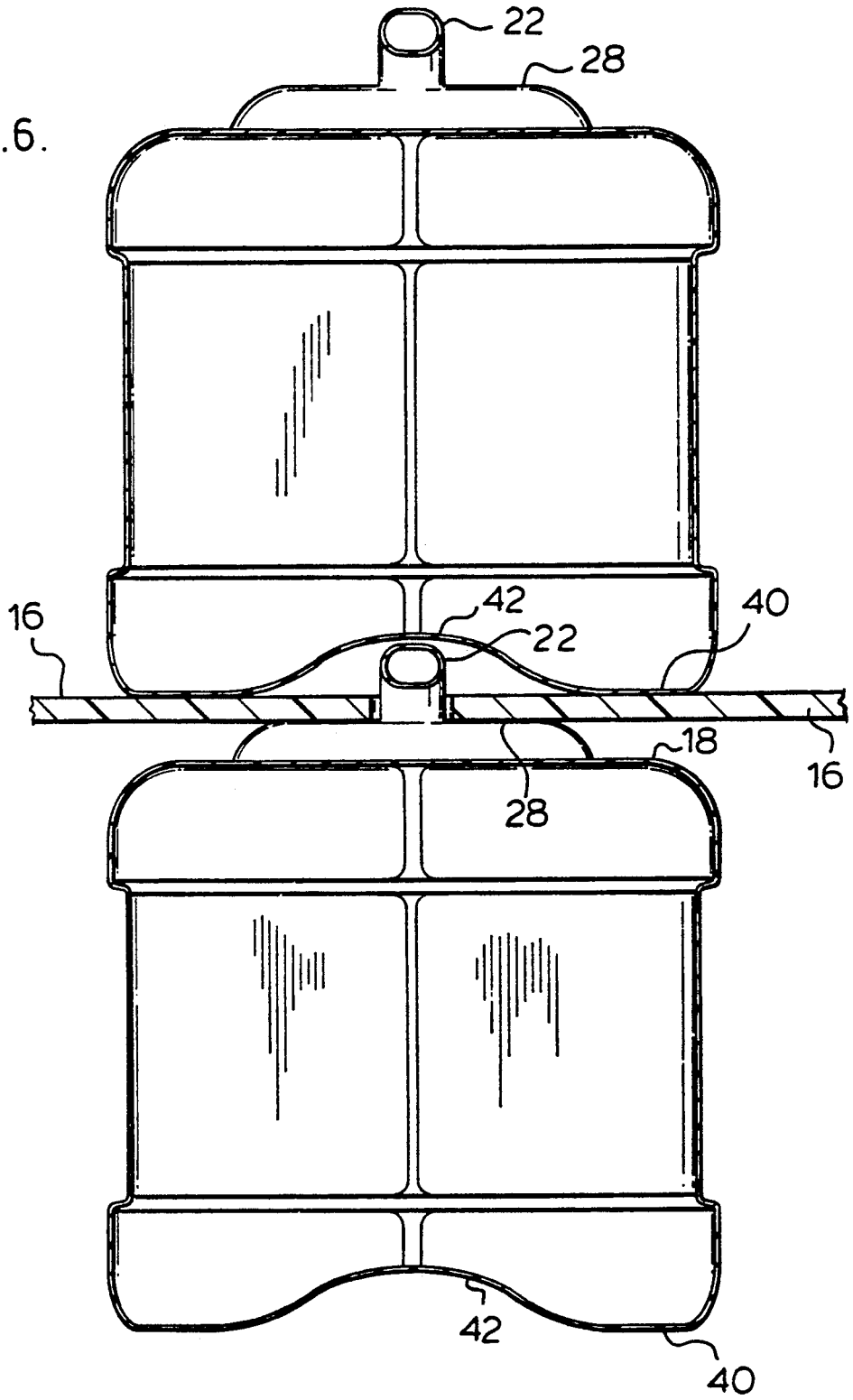
FIG. 6 is a sectional view of two stacked bottles along the lines 2—2 of FIG. 2.

Referring to FIG. 4, bottle container 14 has a bottom surface 40. Bottom surface 40 has a recess 42 extending along parting line 17. The contour of recess 42 is complementary to the shape of handle 22 as illustrated in FIG. 5. As illustrated, an upper bottle container 14 is stacked on top of a lower bottle container whereby handle 22 of the lower bottle 14 extends into the recess 42 of an upper bottle 14.

Figure 8:
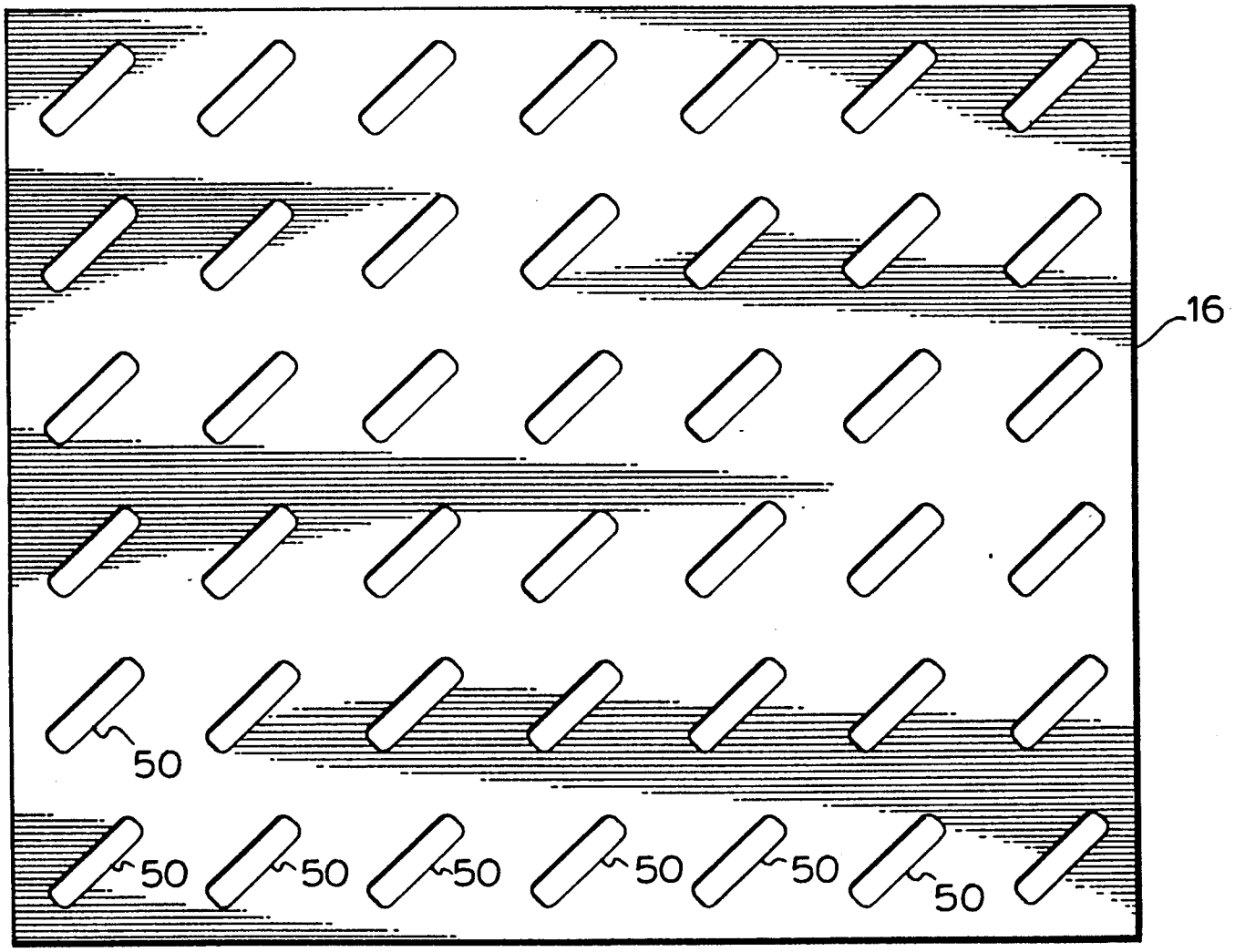
FIG. 8 is a top plan view of a divider according to the invention of FIG. 1.
Figure 9:
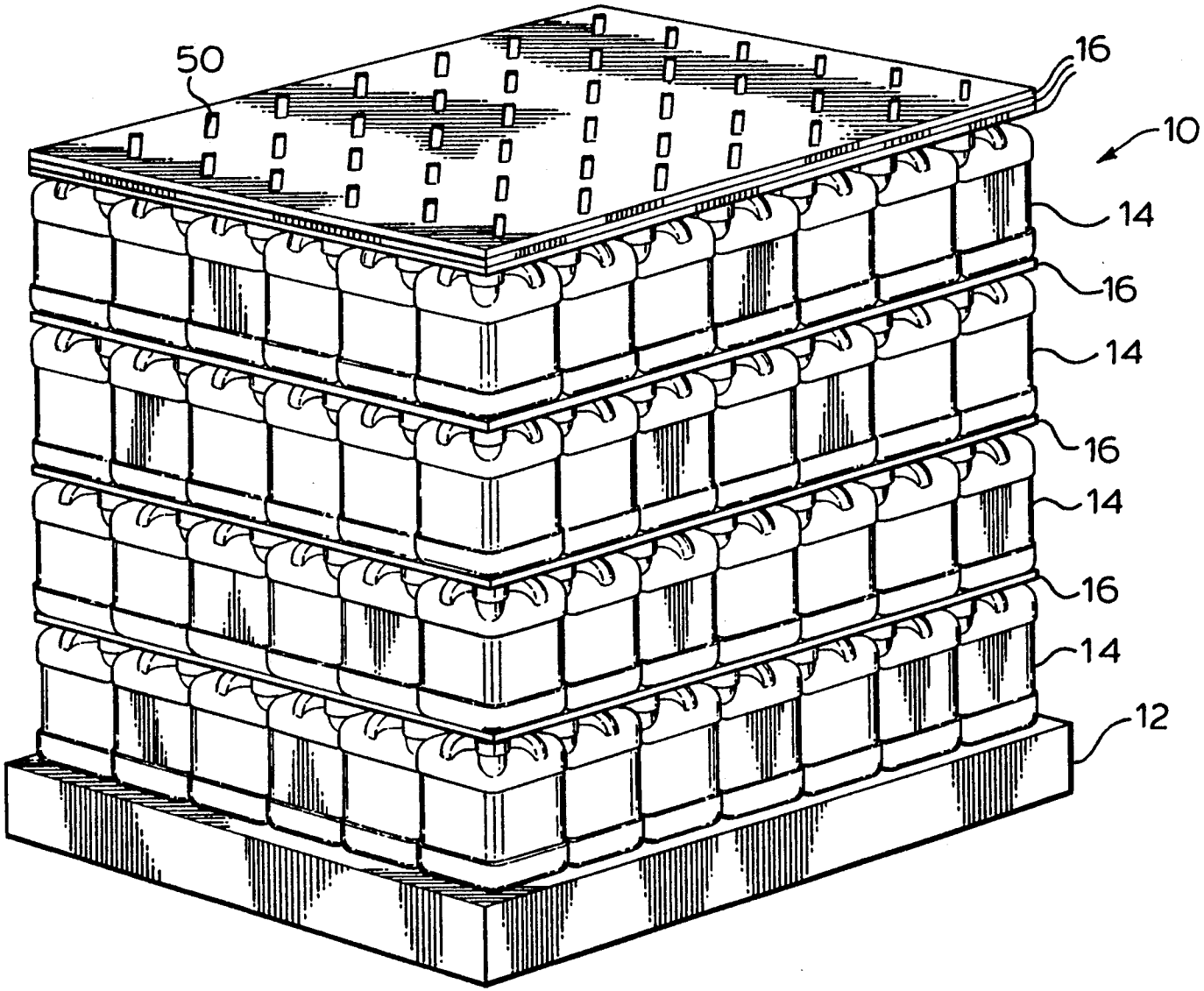
FIG. 9 is a perspective view of the pallet merchandising system according to the invention of FIG. 1.

Divider 16 as illustrated in FIG. 8 has a plurality of diagonally extending slots 50. The number of slots equals the number of bottle containers 14 which fit onto a standard pallet 12. The length and width of the divider 16 is substantially equal to the size of a standard pallet. The diagonal slots 50 are sized and spaced to receive handles 22 of bottle containers 14.

Divider 16 can be manufactured from any suitable sheet material such as cardboard, interleaved corrugated sheets and plastic sheets.

In use, bottle containers 14 are blow molded using an olefin material such as polyethylene. The selection of material is well known in the art and depends primarily upon cost considerations and the type of material to be contained within the bottle container 14.

Figure 7:
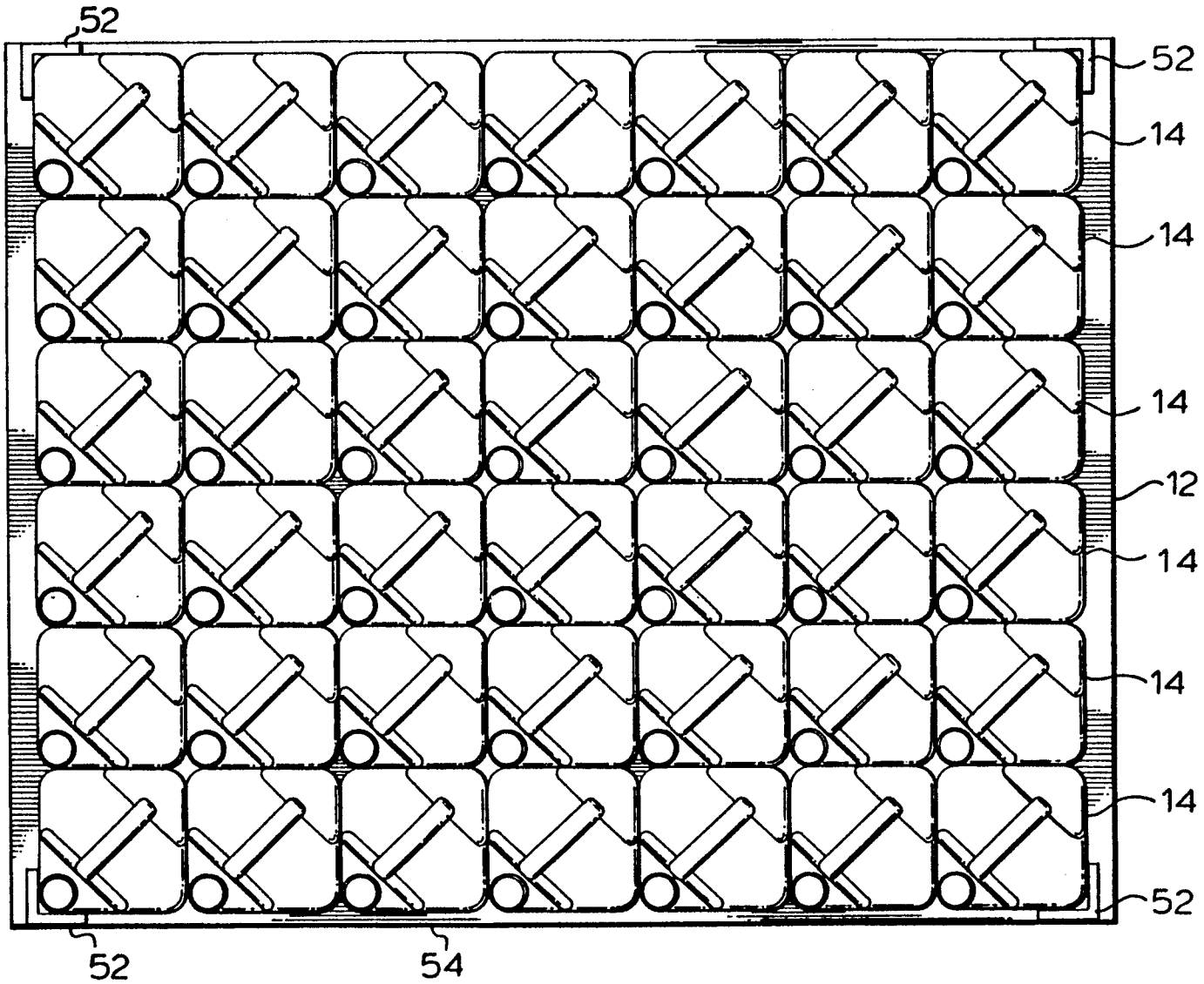
FIG. 7 is a top plan view of the pallet system according to the invention of FIG. 1.

Following manufacture of the bottle container 14, the bottle container 14 is filled with product. Products suitable for filling include liquid products such as driveway sealer, deck sealer, asphalt packing compound, antifreeze, windshield washer fluid, fertilizer, varsol and detergent and dry powdered products such as detergents, fertilizers, lime, cement patching compounds, insecticides and pool Once filled, spout 20 is suitably capped and sealed. A plurality of like bottle containers 14 are placed onto the pallet 12 as illustrated in FIG. 7. With the handle on the diagonal parting line and the spout offset to one corner, the bottles container 14 are easily aligned and oriented whereby the front face 34 of each bottle is facing in the same direction. A suitable number of bottle containers are placed on the pallet 12 in an array format until the pallet is fully covered. Divider 16 is placed over the array of bottle containers 14. Divider 16 rests upon the support surfaces 28 and 30 of each bottle container and handles 22 extend through slots 50.

As illustrated in FIG. 1, upper layers of bottle containers 14 are stacked in a similar manner over top of the lower layer of bottle containers 14. Depending on the size of each bottle container 14 and the weight of the product contained therein, several layers of bottles may be stacked onto pallet 12. At the upper level of bottle containers a plurality of like dividers 16 may be layered together to fully cover the handles 22 of the upper row of bottle containers 14, presenting a substantially planar surface. Depending on the strength of the bottle containers 14 and the weight of the entire pallet, a like pallet load of bottle containers may be stacked on top of the original pallet load.

Once fully loaded, the stack of bottle containers 14 can be wrapped using pallet wrap or a corrugated sleeve 54. In order to protect the corners of the stack, cardboard corners 52 can be used. Once wrapped, the pallet is ready for normal transportation and shipping. Once delivered to the retailer, a forklift or other trucking device may be used to transport the pallet load of bottle containers to the desired aisle or high traffic area. The pallet wrap or corrugated sheet 54 is a uniform display front. The consumer removes the bottle containers 14, one by one, until the top layer is gone. The divider 16 is then removed presenting a new layer of bottle containers 14. This step is repeated until each layer has been removed. From the initial moment of placement, all container labels are visible and oriented in the same direction. This orderly graphic display never changes as the containers are removed and sold.

Further, the interlocking handles prevent the consumers from accessing lower layers until the upper layers have been removed. This prevents the consumer from disturbing the stability or the aesthetics of the display. The added advantage of the dividers allows the display to be stable enough to be used on sloping driveway apron in outdoor locations such as gas stations or garden/building supply yards.

As a further added advantage, the dividers 16, corner supports 52, pallet wrap or corrugated sheet 54 may all be stored and returned with the pallet for reuse, thereby reducing packaging waste.

It is now apparent to a person skilled in the art that numerous products could be packaged using the present invention. However, since many other modifications and purposes of this invention become readily apparent to those skilled in the art upon perusal of the foregoing description, it is to be understood that certain changes in style, size and components may be effective without a departure from the spirit of the invention and within the scope of the appended claims.

I claim:

1. A palletized merchandising system comprising a pallet, a plurality of like containers stacked in layers on said pallet, a divider sheet interposed between said layers of like containers, wherein the improvement is characterized by said like containers comprising a unitary blow molded body of a generally parallelepiped shape, said like containers having a top face, bottom face, a front face and side walls and a diagonally extending parting line, a pour spout in said top face spaced along said parting line towards one corner of said top face, a handle on the top face extending upwardly therefrom and spaced along the parting line, a recess in said bottom face extending upwardly therefrom and spaced along the parting line, said recess sized to receive a handle of a like container in a stacking relation, and said divider sheets having a plurality of apertures adapted to receive said handles of said like containers and to orient the front face of said like containers when an upper layer of like containers is stacked over a lower layer of like containers.

* * * * *